US010835013B2

(12) United States Patent
Maurin et al.

(10) Patent No.: US 10,835,013 B2
(45) Date of Patent: Nov. 17, 2020

(54) CONTAINER WITH DISPENSING TIP

(71) Applicant: HCT GROUP HOLDINGS LIMITED, Central (CN)

(72) Inventors: Denis Pierre Maurin, Los Angeles, CA (US); Armando Villarreal, Los Angeles, CA (US)

(73) Assignee: HCT GROUP HOLDINGS LIMITED, Hong Kong (CN)

( * ) Notice: Subject to any disclaimer, the term of this patent is extended or adjusted under 35 U.S.C. 154(b) by 0 days.

(21) Appl. No.: 16/164,089

(22) Filed: Oct. 18, 2018

(65) Prior Publication Data

US 2019/0045904 A1 Feb. 14, 2019

Related U.S. Application Data

(63) Continuation of application No. 14/842,138, filed on Sep. 1, 2015, now abandoned.

(60) Provisional application No. 62/044,655, filed on Sep. 2, 2014.

(51) Int. Cl.
*A45D 34/04* (2006.01)

(52) U.S. Cl.
CPC ..... *A45D 34/04* (2013.01); *A45D 2200/056* (2013.01)

(58) Field of Classification Search
CPC ..... A45D 34/04; A45D 220/056; A45D 2200/056
USPC ..... 222/207
See application file for complete search history.

(56) References Cited

U.S. PATENT DOCUMENTS

| | | | | |
|---|---|---|---|---|
| 2,459,733 | A | 1/1949 | Macy | |
| 2,600,426 | A | 6/1952 | Paul | |
| 2,715,236 | A * | 8/1955 | Tereno | B05B 11/3032 401/151 |
| 2,755,968 | A | 7/1956 | Fiant | |
| 2,982,987 | A | 5/1961 | Knapp | |
| 3,183,538 | A | 5/1965 | Otto | |
| 3,337,901 | A | 8/1967 | Schefer et al. | |
| 3,602,601 | A | 8/1971 | Zenger et al. | |
| 3,644,707 | A | 2/1972 | Costello | |
| 3,710,985 | A | 1/1973 | Baum | |
| 3,733,634 | A | 8/1973 | Golbe | |

(Continued)

FOREIGN PATENT DOCUMENTS

| | | |
|---|---|---|
| CN | 2606543 Y | 3/2004 |
| CN | 1499988 A | 5/2004 |

(Continued)

OTHER PUBLICATIONS

Affidavit of Armando Villarreal, State of California, County of Los Angeles, Mar. 19, 2013, 4 pages.

(Continued)

*Primary Examiner* — Jeremy Carroll
(74) *Attorney, Agent, or Firm* — Seager, Tufte & Wickhem LLP

(57) ABSTRACT

Containers for distributing products are disclosed. The containers comprise a bottle having at least one sidewall and defining a cavity therein. The bottle has at least one opening. The containers also include an actuator comprising at least one sidewall defining a cavity therein. The bottle also includes a tip including an orifice. The orifice is configured to dispense product therethrough. The actuator is positioned between the bottle and the tip.

14 Claims, 7 Drawing Sheets

(56) References Cited

U.S. PATENT DOCUMENTS 3,774,231 A 11/1973 Tullos
3,891,827 A 6/1975 Wyse
4,027,348 A 6/1977 Flowers
4,029,422 A 6/1977 Pillsbury
4,056,707 A 11/1977 Farnam
4,182,497 A 1/1980 Ferreira
4,291,685 A 9/1981 Taelman
4,312,333 A 1/1982 Dreybus
4,446,880 A 5/1984 Gueret et al.
4,465,073 A 8/1984 Schwob
4,470,715 A 9/1984 Reuchin
4,511,427 A 4/1985 Karliner
4,551,038 A 11/1985 Baker
4,592,745 A 6/1986 Rex et al.
4,602,741 A 7/1986 Faulkner, III et al.
4,603,448 A 8/1986 Middleton et al.
4,704,088 A 11/1987 Newman
4,708,267 A 11/1987 Sieverding et al.
D293,834 S 1/1988 White et al.
4,869,612 A 9/1989 Mooney et al.
4,874,117 A 10/1989 Kay et al.
4,880,326 A 11/1989 Spivey
D307,191 S 4/1990 Blutenthal
4,917,132 A 4/1990 Tuchman
4,983,059 A 1/1991 Holloway
5,025,960 A 6/1991 Seager
5,116,154 A 5/1992 Fulkerson
5,180,244 A 1/1993 Hirose
5,188,472 A 2/1993 Sgro
5,316,196 A 5/1994 Reich
5,531,763 A 7/1996 Mastri et al.
5,626,472 A 5/1997 Pennetta
5,690,441 A 11/1997 McManus
5,816,728 A 10/1998 Nardolillo et al.
5,951,185 A 9/1999 Kingsford et al.
5,964,021 A 10/1999 Stoffel
6,009,887 A 1/2000 Hertel
6,027,272 A 2/2000 Spencer
D425,669 S 5/2000 Gavin
6,062,757 A 5/2000 Gueret
6,068,421 A 5/2000 Pierpont
6,102,518 A 8/2000 Taylor
6,102,602 A 8/2000 Kageyama
6,129,469 A 10/2000 Messer et al.
6,139,553 A 10/2000 Dotan
6,164,857 A 12/2000 Wolfarth-Brooks et al.
6,241,412 B1 * 6/2001 Spies ..... A46B 11/002 206/532
6,261,014 B1 7/2001 Altobellis et al.
6,287,034 B1 9/2001 Miraglia et al.
6,290,416 B1 9/2001 Gueret
6,402,411 B2 6/2002 Spencer et al.
6,565,523 B1 5/2003 Gabourie
6,607,323 B2 8/2003 Breidenbach et al.
6,669,389 B2 12/2003 Gueret
6,758,374 B2 7/2004 Albisetti
6,789,970 B1 9/2004 Shearon et al.
6,872,020 B2 3/2005 Epli
6,923,589 B2 8/2005 Blackwell
6,942,412 B2 9/2005 Gueret
7,040,830 B2 5/2006 Kliegman
7,082,970 B2 8/2006 Bartholomew
7,083,347 B2 8/2006 Marcotte
D532,936 S 11/2006 Bakic
D533,309 S 12/2006 Nobuto et al.
7,172,357 B2 2/2007 Gueret
D538,480 S 3/2007 Chen
D554,291 S 10/2007 Darnell et al.
7,282,037 B2 10/2007 Cho
D555,831 S 11/2007 Chan
7,306,442 B2 12/2007 Fox
D570,545 S 6/2008 Althoff et al.
7,384,208 B2 6/2008 Bouix et al.
7,398,898 B2 7/2008 Bouix
7,429,141 B2 9/2008 Habatjou
7,614,404 B2 11/2009 Kee
7,638,144 B2 12/2009 Rhaodes
D617,050 S 6/2010 Lou
7,785,026 B2 8/2010 Eng
D632,014 S 2/2011 Lee
7,883,287 B2 2/2011 Thorpe
D633,653 S 3/2011 Lee
7,927,032 B2 4/2011 Sanchez
7,959,369 B2 6/2011 Gueret
8,028,707 B2 10/2011 Wyatt et al.
8,074,665 B2 12/2011 Pires
D653,805 S 2/2012 Tani
8,161,983 B1 4/2012 Lee
D663,483 S 7/2012 Lee
8,267,606 B2 9/2012 Delbove et al.
8,292,535 B2 10/2012 Thorpe
8,297,867 B2 10/2012 Nasu et al.
8,336,790 B2 * 12/2012 Kolins ..... A61L 9/12 222/206
8,360,674 B2 1/2013 Dwyer
8,573,874 B2 11/2013 Neuner
D704,066 S 5/2014 de Lima Paschoal et al.
8,864,401 B2 10/2014 Duru
9,629,438 B2 * 4/2017 Bruder ..... A45D 34/04
2001/0047949 A1 12/2001 Bono
2002/0029859 A1 3/2002 Weaver
2002/0082625 A1 6/2002 Huxel et al.
2002/0121239 A1 9/2002 Tonazzi et al.
2002/0166631 A1 11/2002 Dewitt
2002/0185396 A1 12/2002 Mainwaring et al.
2003/0060925 A1 3/2003 Bartholomew et al.
2003/0129363 A1 7/2003 Hoeft et al.
2003/0171762 A1 9/2003 Forchette et al.
2003/0231924 A1 12/2003 Libman et al.
2004/0018037 A1 1/2004 Gueret
2004/0034315 A1 2/2004 Chen
2004/0127952 A1 7/2004 O'Phelan et al.
2004/0190975 A1 9/2004 Goodman et al.
2004/0211789 A1 10/2004 Osborn et al.
2004/0222124 A1 11/2004 Byun
2004/0249320 A1 12/2004 Yamazaki et al.
2005/0000534 A1 1/2005 Tien
2005/0047848 A1 3/2005 Carraher
2005/0175786 A1 8/2005 Singh et al.
2005/0197268 A1 9/2005 Buskirk et al.
2005/0249539 A1 11/2005 Habatjou
2005/0268409 A1 12/2005 Blaustein et al.
2006/0032512 A1 2/2006 Kress et al.
2006/0039742 A1 2/2006 Cable, Jr. et al.
2006/0049203 A1 3/2006 Boone et al.
2006/0065677 A1 * 3/2006 Py ..... A45D 34/04 222/383.1
2006/0093425 A1 5/2006 Gueret
2006/0093426 A1 5/2006 Tsaur
2006/0198686 A1 * 9/2006 Hetzel ..... A45D 34/00 401/47
2006/0207627 A1 9/2006 Thorpe et al.
2006/0216104 A1 9/2006 Bouix et al.
2006/0216256 A1 9/2006 Giniger et al.
2006/0272668 A1 12/2006 Wyatt et al.
2006/0275072 A1 12/2006 Petit
2007/0034224 A1 2/2007 Dumler
2007/0102455 A1 * 5/2007 Stark ..... A61M 11/08 222/207
2007/0116509 A1 5/2007 Lin
2007/0186950 A1 8/2007 Roeder
2007/0186951 A1 8/2007 Gueret
2007/0272269 A1 11/2007 Wyatt et al.
2007/0289602 A1 12/2007 Simmons
2008/0060668 A1 3/2008 Legassie
2008/0138138 A1 6/2008 Gueret
2008/0166172 A1 7/2008 Eng et al.
2008/0193193 A1 8/2008 Pechko et al.
2008/0286030 A1 11/2008 Roder
2009/0071499 A1 3/2009 Wyatt et al.
2009/0194120 A1 8/2009 Pires et al.
2009/0194127 A1 8/2009 Pires et al.
2009/0236374 A1 * 9/2009 Pardes ..... A61F 9/0008 222/494

(56) References Cited

U.S. PATENT DOCUMENTS

| | | | | |
|---|---|---|---|---|
| 2010/0037407 | A1 | 2/2010 | Telwar | |
| 2010/0178095 | A1 | 7/2010 | Bouix | |
| 2010/0224208 | A1 | 9/2010 | Thorpe et al. | |
| 2010/0243677 | A1 | 9/2010 | Lim | |
| 2010/0300474 | A1 | 12/2010 | Tsai | |
| 2011/0123248 | A1 | 5/2011 | Kim | |
| 2011/0123252 | A1 | 5/2011 | Thorpe | |
| 2011/0176856 | A1 | 7/2011 | Gardner et al. | |
| 2011/0284579 | A1* | 11/2011 | Pardes | A61F 9/0008 222/207 |
| 2012/0014736 | A1 | 1/2012 | Pires et al. | |
| 2012/0065555 | A1 | 3/2012 | Chae et al. | |
| 2012/0282008 | A1 | 11/2012 | Geuther et al. | |
| 2013/0048658 | A1 | 2/2013 | Sawata | |
| 2013/0012174 | A1 | 5/2013 | Tarling et al. | |
| 2013/0121748 | A1 | 5/2013 | Ramirez | |
| 2013/0134189 | A1 | 5/2013 | Kageyama et al. | |
| 2013/0146618 | A1* | 6/2013 | Bae | A45D 34/02 222/183 |
| 2013/0343798 | A1 | 12/2013 | Delage et al. | |
| 2013/0343800 | A1 | 12/2013 | Drugeon et al. | |
| 2014/0197208 | A1 | 7/2014 | Bertin et al. | |
| 2014/0219701 | A1 | 8/2014 | Eberlein | |
| 2014/0234004 | A1 | 8/2014 | Thorpe | |
| 2014/0234010 | A1 | 8/2014 | Thorpe et al. | |
| 2014/0328611 | A1* | 11/2014 | Ishida | A45D 34/04 401/184 |
| 2016/0058155 | A1 | 3/2016 | Maurin et al. | |

FOREIGN PATENT DOCUMENTS

| | | | |
|---|---|---|---|
| CN | 200941885 | Y | 9/2007 |
| EP | 0181184 | A2 | 5/1986 |
| EP | 2084986 | A2 | 8/2009 |
| FR | 1050060 | A | 1/1954 |
| JP | 8238884 | A | 9/1996 |
| JP | 2000102583 | A | 4/2000 |
| JP | 2000279870 | A | 10/2000 |
| JP | 2001000497 | A | 1/2001 |
| JP | 2005211182 | A | 8/2005 |
| JP | 2005319300 | A | 11/2005 |
| JP | 2006247037 | A | 9/2006 |
| KR | 20-1998-056332 | U | 10/1998 |
| KR | 20050000059 | A | 1/2005 |
| KR | 200398534 | Y1 | 10/2005 |
| KR | 20060026096 | A | 3/2006 |
| KR | 2020120003955 | U | 6/2012 |
| WO | 9211785 | A1 | 7/1992 |
| WO | 0108529 | A2 | 2/2001 |
| WO | 2007117091 | A1 | 10/2007 |
| WO | 2011083427 | A2 | 7/2011 |
| WO | 2011086427 | A1 | 7/2011 |
| WO | 2012032148 | A1 | 3/2012 |

OTHER PUBLICATIONS

Affidavit of Jenny Hsu—Attachment F, Park, "HCT produces metal tips for latest Dior cosmetics range," Packaging News, Sep. 3, 2009, retrieved at <<http://www.packagingnews.co.ukldesign/hct-produces-metal-tips-for-latest-diorcosmetics-range/>> 2 pages.

Affidavit of Jenny Hsu—Attachment G, "Vichy Neovvadiol of Lip & Eye Contour by HCT Packaging," Packaging Europe, Jun. 2011, 2 pages.

Affidavit of Jenny Hsu—Attachment H, "Armani Turns to HCT for New Eye Serum Packs," Packaging News, Sep. 26, 2011, 2 pages.

Affidavit of Jenny Hsu—Attachment I, "Armani Chose the HCT Patented Metal Tip Applicators for Their New Eye Serum," Packaging Europe, Sep. 2011, 2 pages.

Affidavit of Jenny Hsu, Attachment A, "2009 HBA IPDA Winners Annouced" Beauty Packaging Magazine, Oct./Nov. 2009, retrieved at <<http://www.beautypackaging.com/articles/2009/10/2009-hba-ipda-winners-announced>> 3 pages.

Affidavit of Jenny Hsu, Attachment B, "CosmetidPersonal Care Packaging, 2009 Editor's Choice Award Winner: Personal Care," Cosmetic & Personal Care Packagining Magazine I USA, May 2009, retrieved at <<http://www.cpcpkg.com/magazine/09 05 perfekt.php>> 3 pages.

Affidavit of Jenny Hsu, Attachment C, "Cosmoprof Bologna Draws Growing International Crowd," BeautyPackaging Magazine, Apr./May 2012, retrieved at <<http://beta.nutraceuticalsworld.comarticles/20 12/05/cosmoprof-bologna-draws-growinginternational-crow>> 2 pages.

Affidavit of Jenny Hsu, Attachment D, "HCT's patented cooling tip technology wins award for Clinique Lid Smoothies" BeautyPackaging Magazine, Oct. 2012, Press release, HCT Innovation on demand, 3 pages.

Affidavit of Jenny Hsu, Attachment E, "HCT Develops Dispensing Concept: Zamac Tips Add a High Dose of Cool," Beauty Packaging Magazine, Oct./Nov. 2009, retrieved at <<http://www.beautypackaging.com/articles/2009/1O/design-center>> 3 pages.

Affidavit of Jenny Hsu, including Exhibits A-I, State of California, county of Lost Angeles, Jan. 2013, 26 pages.

"Blistex—Lip Splash, Rolling Tip Applicator, Lip Moisturizer, SPF for Your Lips, Bermat . . . ", retrieved on May 10, 2007 at <http://www.blistex.eu/whats_new.htm>, 1 page.

"Communication Accompanying Information Disclosure Statement," for U.S. Appl. No. 13/656,993, Timothy Thorpe, "Dispenser With Thermal Storage Tip," May 14, 2013, 2 pages "Cosmogen Innovation in Progress," retrieved on Jun. 20, 2008, 1 page.

"Energizer L91 Ultimate Lithium", Product Datasheet, retrieved on Feb. 5, 2013, at <<Htpp://data.energizer.com/PDFs/I91.pdf>>, Energizer Holdings, Inc., pp. 1-2.

"Frequently Asked Questions About Our Cooling and Heating Technology", retrieved on Feb. 5, 2013, at <<http://www.tellurex.com/technology/peltier-gaq.php>>, Tellurex, 2009-2011, pp. 1-14.

HCT Answer Brief to Third Korean Invalidation Brief (Summary Translation), filed Apr. 29, 2013, 7 pages.

Lancome Oscillation Powderfoundation, retrieved on Mar. 8, 2010, at <<http://www.lancome-usa.com/makeup/foundations/oscillation-powerfoundation,aspx>>, p. 1 of 1.

"Part Number: CP Series, Description: application notes", V-Infinity, a division of CUI, Inc., Jan. 2009, pp. 1-8.

Response to Korean Invalidation Petition (and Summary Translation) in response to Invalidation Action filed in reference to Korean Patent No. 800040, dated Mar. 25, 040, dated Mar. 25, 2013, 60 pages.

Response to Non-Final Office Action for U.S. Appl. No. 11/747,078, dated Sep. 16, 2010, Timothy Thorpe, "Dispenser with Thermal Storage Tip," 10 pages.

Response to Non-Final Office Action for U.S. Appl. No. 13/022,193, dated Jul. 30, 2012, Timothy Thorpe, "Dispenser with Thermal Storage Tip," 18 Pages.

Sephora, Urban Decay Cosmetics, retrieved on Mar. 11, 2010 at <<http://www.sephora.com/browse/product.jhtml?id=P204729&cm_mmc=us_search-_-GoogleBase-_-P204729-_-1051143&_requestedid=42976&ci_src=14110944&ci_src=14110944&ci_sku=1051143>>, 5 pages.

"Series: CP20, Description:2.0 A Peltier Module", retrieved on Feb. 5, 2013 at <<http://cui.com/Product/Resource/PDF/CP20.pdf>>, CUI,Inc May 7, 2012, pp. 1-5.

"Super simple PWM TEC controller", retrieved on Feb. 5, 2013, at <<http://redlum.xohp.pagesperso-orange.fr/electronics/simplePWM-TEC.html>>, Welcom to W's Laser-Projects Page!., Vers. 1.0, Aug. 2010. pp. 1-3.

The Notice: a beauty blog "Too much of a good thing is still totally a good thing. | Clinique Almost Lipstick review, photos, swatches (Spring 2012 full lineip)" Posted Feb. 25, 2012. Accessed on Aug. 17, 2015. (http://thenotice.net/2012/02/clinique-almost-lipstick-review/).

The Ultimate Makeup blog "Review & Swatches: NARS Fall 2011 Pure Matter Lipsticks in Montego Bay & Mascate" Posted Aug. 12, 2011. Accessed on Aug. 17, 2015. (http://theultimatemakeup.com/post/8833814342/review-swatches-nars-fall-2011-pure-matte).

(56) References Cited

OTHER PUBLICATIONS

Top Skin Care Products, Facial Skin Care, Skin Care Brush—Clarisonic, retrieved on Mar. 8, 2010 <http://www.clarisonic.com/us/>>, pp. 1-2.
Translated First Korean Invalidation Brief dated Nov. 2, 2012, 7 pages.
Translated Second Korean Invalidation Brief, dated Jan. 23, 2013, 7 pages.
Translated Third Korean Invalidation Brief, dated Mar. 28, 2013, 30 pages.
Response to Final Office Action for U.S. Appl. No. 11/747,078, dated Oct. 28, 2010, Timothy Thorpe, "Dispenser with Thermal Storage Tip," 10 pages.
PCT Application No. US2015/047982, the International Search Report and the Written Opinion of the International Searching Authority. 13 Pages. dated Dec. 8, 2015.

* cited by examiner

CONTAINER WITH DISPENSING TIP

CROSS-REFERENCE TO RELATED APPLICATIONS

This application is a continuation of U.S. patent application Ser. No. 14/842,138, filed Sep. 1, 2015, which claims priority under 35 U.S.C. § 119 to U.S. Provisional Application Ser. No. 62/044,655, filed Sep. 2, 2014, the disclosures of which are incorporated herein by reference

TECHNOLOGY FIELD

The present application relates generally to a container with dispensing tip. In some embodiments, the dispensing tip is adapted for delivering product from the container in a stream or dropwise fashion.

BACKGROUND

Often, fluids, such as liquids, semi-liquids and the like, are desired to be held in a container until dispensing is desired. There are a multitude of ways to accomplish storage and dispensing, and a continuing need to refine and redefine these ways, particularly in the competitive world of cosmetics.

BRIEF SUMMARY

This disclosure provides design, material, manufacturing method, and use alternatives for medical devices. An example medical device, comprises: a stent including a plurality of longitudinally extending filaments, the stent having an inner surface and an outer surface; a plurality of tubular members extending along the stent; wherein each of the plurality of tubular members is coupled with one or more of the plurality of longitudinally extending filaments; and wherein each of the plurality of tubular members is configured to accept a radioactive element, a spacer or both.

Alternatively or additionally to any of the embodiments above, wherein the actuator includes a compressible sleeve, and wherein the amount of compression applied to the sleeve controls the amount of the product dispensed through the tip.

Alternatively or additionally to any of the embodiments above, wherein the tip includes a first flange and wherein the actuator includes a second flange, and wherein the first flange and the second flange are designed to mate.

Alternatively or additionally to any of the embodiments above, wherein the bottle includes a third flange and wherein the second flange and the third flange are designed to mate. Alternatively or additionally to any of the embodiments above, wherein the mating connection of the first flange and the second flange includes a snap fit connection, and wherein the mating connection of the second flange and the third flange includes a snap fit connection.

Alternatively or additionally to any of the embodiments above, wherein the snap fit connections are configured such that the tip, the bottle, or both the tip and the bottle are replaceable. Alternatively or additionally to any of the embodiments above, further comprising an upper collar, wherein the upper collar is positioned around the circumference of the tip, and wherein the upper collar is configured to prevent the actuator from moving longitudinally with respect to the tip.

Alternatively or additionally to any of the embodiments above, further comprising an annular collar, wherein the annular collar includes a first flange, and wherein the bottle includes a second flange, and wherein first flange is designed to mate with the second flange.

Alternatively or additionally to any of the embodiments above, wherein the annual collar is coupled to the actuator, the bottle, or both the actuator and the bottle. Alternatively or additionally to any of the embodiments above, wherein the container includes an end cap coupled to an end region positioned opposite the tip. Alternatively or additionally to any of the embodiments above, wherein the container further comprises a dip tube coupled to the tip, wherein the dip tube extends from the tip toward the end cap.

Another example container for dispensing a cosmetic product, comprises a rigid bottle having at least one sidewall and at least one opening; a flexible actuator configured to receive a product from the rigid bottle; a tip including an orifice, the tip configured to receive a product from the flexible actuator; and wherein the orifice is configured to dispense product therethrough; wherein the tip, the bottle or both the tip and the bottle are replaceable.

Alternatively or additionally to any of the embodiments above, wherein the actuator is positioned between the bottle and the tip such that the actuator is designed to control the amount of product dispensed through the tip orifice. Alternatively or additionally to any of the embodiments above, wherein the flexible actuator is capable of being compressed, and wherein the amount of compression applied to the actuator corresponds to the amount of product dispensed through the tip. Alternatively or additionally to any of the embodiments above, wherein the bottle is coupled to the actuator via a snap connection and wherein the tip is coupled to the actuator via a snap connection.

Alternatively or additionally to any of the embodiments above, further comprising an upper collar positioned adjacent the tip, wherein the upper collar is configured to prevent the actuator from moving longitudinally with respect to the tip.

Alternatively or additionally to any of the embodiments above, wherein the bottle includes a first flange and the actuator includes a second flange, and wherein the first flange is designed to mate with the second flange.

Alternatively or additionally to any of the embodiments above, wherein the first flange includes at least one outwardly extending portion, and wherein the second flange includes at least one inwardly extending portion, and wherein the inwardly extending portion is designed to mate with the outwardly extending portion.

Alternatively or additionally to any of the embodiments above, further comprising an annual collar coupled to the actuator, the bottle or both the actuator and the bottle, wherein the annual collar is designed to prevent longitudinal movement of the bottle with respect to the actuator.

Another example container comprises a bottle having at least one rigid sidewall and defining a cavity therein and defining an open end; a dispensing actuator comprising at least one flexible sidewall defining a cavity therein; and a dispensing tip defining a dispensing orifice permitting the flow of a product therethrough upon application of external pressure upon the dispensing actuator; wherein the dispensing actuator fluidly connects the bottle and the dispensing tip at opposite ends thereof.

The above summary of some embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

The foregoing and other aspects of the container with quick release base and lid assembly are best understood from the following detailed description when read in connection with the accompanying drawings. There are shown in the drawings embodiments that are presently preferred, it being understood, however, that the disclosure is not limited to the specific instrumentalities disclosed. Included in the drawings are the following Figures.

DETAILED DESCRIPTION OF EXEMPLARY EMBODIMENTS

The container and dispensing tip described herein is suitable in a wide-variety of commercial areas, such as cosmetics, medicinal, pharmaceutical, arts, painting, cooking, etc. In short, in any application where a relatively controlled output of product is required. The description herein will focus on the use of the container in the cosmetics industry, but is not meant to so limit the use of the container to that field.

The product to be dispensed can be any desired product which is fluid or flowable. Such products may range from fully liquid to semi-liquid or even a powder. It is contemplated that a wide range of materials and viscosities may be used. An opening in the dispenser can be sized appropriately to facilitate dispensing thicker fluids or to hold back thinner fluids until dispensing is desired.

As shown throughout the figures and described in more detail with respect to various embodiments below, the container comprises a multi-part system including a bottle defining a product reservoir, a dispensing actuator (or squeeze area), and a dispensing tip, such that the dispensing actuator is disposed between the bottle and the dispensing tip, whereby pressure applied to the dispensing actuator, rather than the bottle, forces product out through the dispensing tip. The dispensing tip, dispensing actuator, and bottle can be made of any suitable material and may be fluidly connected to one another via any suitable means. The Figures represent a variety of examples and the descriptions below are meant to be illustrative in nature. Those of skill in the art will appreciate variations in shape, size, configuration, material choice, and other characteristics without deviating from the spirit and scope of this disclosure.

Figure 1C:
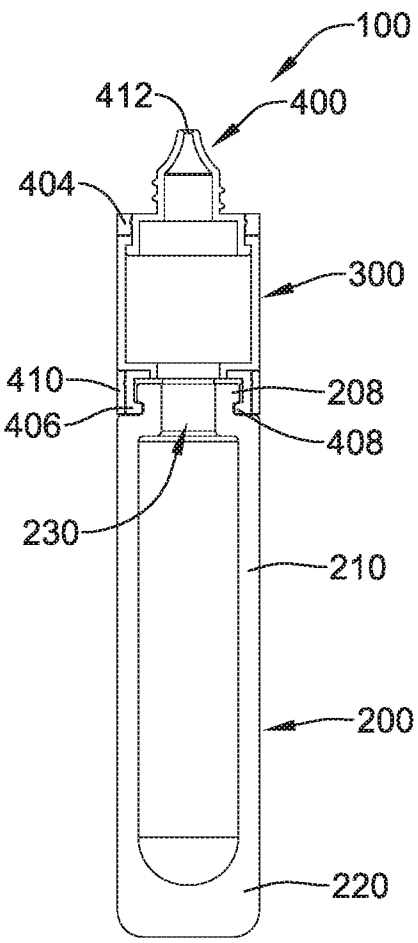
FIG. 1C is a cross-sectional side view of the container of FIG. 1A, with the cap removed.
Figure 1B:
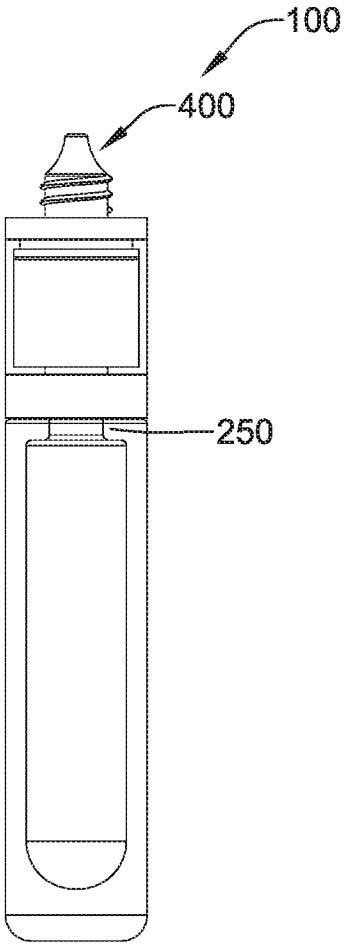
FIG. 1B is a side view of the container of FIG. 1A, with the cap removed.
Figure 1A:
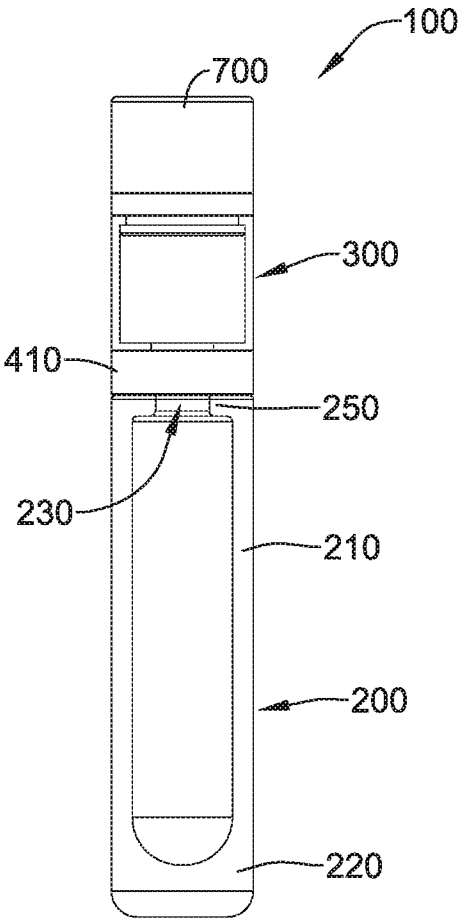
FIG. 1A is a side view of an example container.

As shown in FIGS. 1A-1C, the container 100 comprises a multi-part system, including a bottle 200 for containing the product, a dispensing actuator 300, a dispensing tip 400 (here a nozzle), and at least one collar to connect the various pieces. It will be appreciated that the various parts can be formed in any manner and interconnected with one another in a variety of ways.

A separate cap 700 may also be provided.

The bottle 200 may be a rigid bottle, made of glass, polypropylene, PET, PETG, PETE, PCTG, SAN, clarified ABS, acrylic (PMMA), or other material suitable for housing the product. The term "rigid," as used herein, means that the bottle's sidewalls may not flex under normal hand pressures. The dimensions of the bottle 200 may remain substantially constant regardless of environment or manual manipulations. In some instances small amounts of expansion and contraction due to environmental forces may occur, however, such changes may occur in all materials and are not expected to alter the performance of the bottle 200. The bottle 200 generally will have at least one sidewall 210 as in the case of a generally cylindrical bottle 200 as shown in FIGS. 1A-1C. The bottle 200 may also have a bottom wall 220. In some instances, the at least one sidewall 210 may come together to form a closed bottom, without having a bottom wall, per se. The at least one sidewall 210 also defines an opening 230 at the end opposite the closed bottom.

Figure 2:
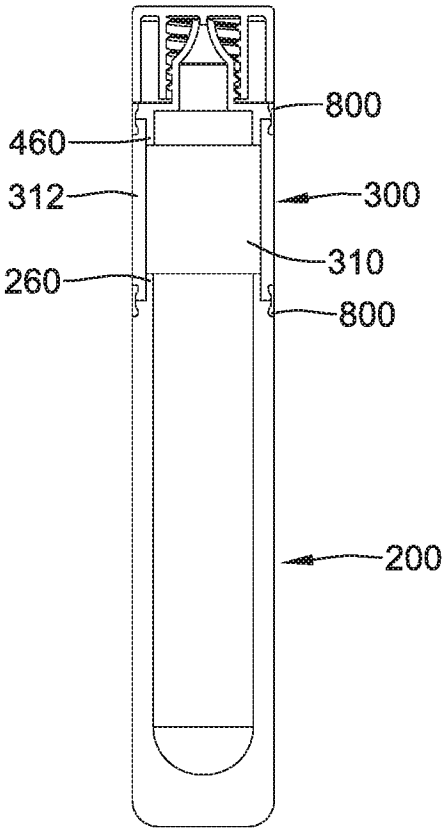
FIG. 2 is a cross-sectional view of a container in accordance with some embodiments.

The opening 230 in the bottle 200 is designed to allow for substantially free-flow of the product contained in the bottle. "Substantially free-flow," as used herein, means that the product moves from the bottle 200 out of the opening 230 by simple inversion of the bottle 200. That is, upon completely or partially inverting the bottle 200, the product contained therein will flow through the opening. It will be appreciated that the viscosity of the product will determine the speed with which such flow is accomplished. In some embodiments, the bottle 200 may have an inner shoulder 250, as seen in FIGS. 1A-1C. In other instances, the bottle may be free of projections (e.g. shoulders) to facilitate more free-flow of product, as shown in FIG. 2.

At the open end of the bottle 200, the container is provided with a dispensing actuator 300. In the case of FIGS. 1A-1C, the dispensing actuator 300 may be a soft sleeve. As shown in FIGS. 1A-1C, the soft sleeve is affixed to the open end of the bottle 200 such that product may flow from the bottle 200 to a void defined by the soft sleeve. As used herein, "soft" may indicate that the soft sleeve is compressible under hand, or more particularly finger, pressure. The dispensing actuator 300 is adapted to provide the proper balance of resistance and compressibility to allow for the user to apply pressure to control the amount and/or speed of the product dispensed.

As shown in the cross-section of FIG. 1C, the dispensing actuator may be generally cylindrical, defined by a sidewall, which, in turn defines a cavity between. The sidewall defines two opposed open ends. At one end, the dispensing actuator 300 is affixed to the dispensing tip 400. As shown in FIG. 1C, the dispensing tip 400 and the dispensing actuator 300 may be coupled to one another via a pair of mated annular flanges 402 and 302, respectively. An upper collar 404 may also be provided. In addition to being decorative, the upper collar 404 can be used to secure the dispensing actuator 300 to prevent axial movement with respect to the dispensing tip 400. Other arrangements for securing the pieces may also be employed, including overmolding, snap fit, frictional fit, threading, etc., some of which are shown in the remaining figures and discussed below. In some instances (as shown, for example, in the embodiment depicted in FIG. 1C), the dispensing actuator 300 may be overmolded with an annular collar 406. Although the figure depicts a clear demarcation between the dispensing actuator 300 and the annular collar 406, due to the over molding process, the two are substantially joined by the melting of materials at the interface. The annular collar 406 is generally more rigid than the dispensing actuator 300 to facilitate its connection with the bottle 200. As depicted, the annular collar 406 is coupled to the bottle 200 via a pair of mated flanges, 408 and 208, on the annular collar 406 and bottle 200, respectively. This arrangement permits a snap fit type connection. FIG. 1C also shows an optional decorative collar 410 around the annular collar 406.

Suitable materials for the dispensing actuator 300 include but are not limited to TPE (thermoplastic elastomer), polyethylene, Surlyn®, rubber, silicone, polypropylene, and the like. As shown in FIGS. 1A-1C, the soft sleeve is a cylindrical shape defined by a sidewall defining two open ends. One end is affixed to and in fluid communication with the bottle 200, and the cavity containing product therein. The opposite end is connected to a dispensing tip 400 (e.g., a nozzle).

The dispensing tip 400 can be any suitable dispensing tip, or possibly a combination of tips, depending upon the desired application. For example, the tip 400 may be a nozzle (as shown in FIGS. 1A-1C) and may include a brush, bristles, a foam applicator, a doefoot, etc. In FIGS. 1A-1C, it is contemplated that the nozzle is well-suited for single drop application, or upon exertion of additional pressure on the soft sleeve, a stream of product. As shown in FIGS. 1A-1C, the nozzle 400 is provided with a dispensing orifice 412. The dispensing orifice 412 is sized and configured relative to the product to be dispensed. In sizing the orifice 412, the design must keep in mind the competing goals of keeping product within the nozzle 400 until desired and the need for relative ease of achieving the desired pressure for proper dispensing.

As mentioned above, the container is adaptable to a wide variety of industries and products within those industries. In the cosmetics industry, the product may range from serum, lipgloss, liquid foundation, cream, liquid eyeliner, liquid blush, nail varnish, liquid concealer, etc. More broadly speaking, the product is any material that is flowable. For example, the product may have a viscosity of about 1 (water) to about 100,000 (sour cream). In some embodiments, the viscosity of the product is about 1 (water) to about 1,000 (motor oil). In some embodiments, the product viscosity is about 50,000 (ketchup) to about 100,000 (sour cream). In some embodiments, the viscosity of the product may be about 1, about 1,000, about 10,000, about 20,000, about 30,000, about 40,000, about 50,000, about 60,000, about 70,000, about 80,000, about 90,000, about 100,000, or any value or range of values between any two of these values.

The dispensing tip 400, dispensing actuator 300, and bottle 200 can be affixed to one another either permanently or removably, and by any suitable means. As shown, one or more of the pieces is provided with mating connectors which are held in place by the upper and lower collars 404/406, which may also provide an aesthetic function. In some embodiments, the bottle 200 is removable from the dispensing actuator 300 and/or tip 400. In this manner, either the dispensing actuator 300 and/or tip 400 can be replaced without losing contents remaining in the bottle 200.

Alternatively, when the container nears empty, the container could be inverted, allowing product to flow from the bottle 200 into the dispensing actuator 300. The bottle 200 could then be removed, and a refill bottle attached. In this manner, minimal product is lost, and the consumer does not need to squeeze the tube to get the final bit of product from the container.

In another alternative, the dispensing tip 400 could be removed and replaced in the event of a clog, or if there is a need to use a different type of applicator. The ability to change dispensing tips gives tremendous flexibility to the single bottle of product.

As depicted in FIGS. 1A-1C, a cap 700 may also be provided such that it seals the dispensing orifice 412 in the dispensing tip 400, to prevent accidental leakage or dispensing.

In use, the bottle 200 may be filled with product and sold to consumers, or in some embodiments, may be Tillable by consumers. In use, the user may shake the bottle 200 to redistribute any settling of product that may have occurred (if necessary depending on the product type). The container may then be fully or partially inverted and, depending on factors such as the product viscosity, any remaining amount left in the bottle 200 may flow into the actuator 300. The user then applies appropriate pressure/compression (e.g. squeezing the actuator) to the dispensing actuator 300. The combination of the applied pressure and the resistance provided by one or more of the dispensing actuator 300, the dispensing tip 400 (and orifice 412), and/or the product viscosity results in product flowing (e.g., dispensing) from the cavity defined by the dispensing actuator 300 into the dispensing tip 400 and out the dispensing nozzle 412. The flow (e.g. dispensing) of product can be controlled by the manual pressure applied by the user.

The remaining figures illustrate various embodiments, particularly with respect to how the various pieces are interconnected.

FIG. 2 depicts an alternative embodiment, wherein the dispensing actuator 300 may be a silicone sleeve fitted over a neck 260 on the bottle 200 at one end and a neck 460 on the dispensing tip at the other. The sleeve 310 is secured in place at either end by a collar 800. The flexible sleeve 310 then defines a cavity for housing product for dispensing and a flexible sidewall 312 to allow for movement of product through the dispensing actuator 300 upon exertion of physical pressure upon the flexible sidewall 310. Annular collar 800 may be used to secure the sleeve 310 to each of the neck 460 and neck 260.

Figure 5:
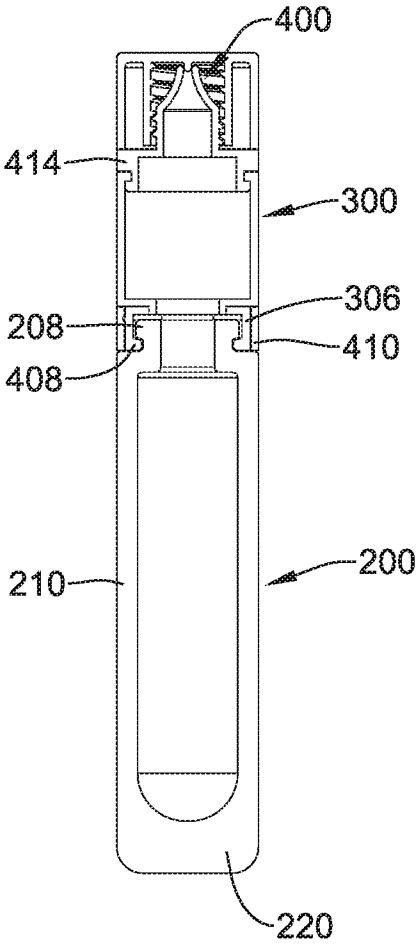
FIG. 5 is a cross-sectional view of a container in accordance with some embodiments.
Figure 4:
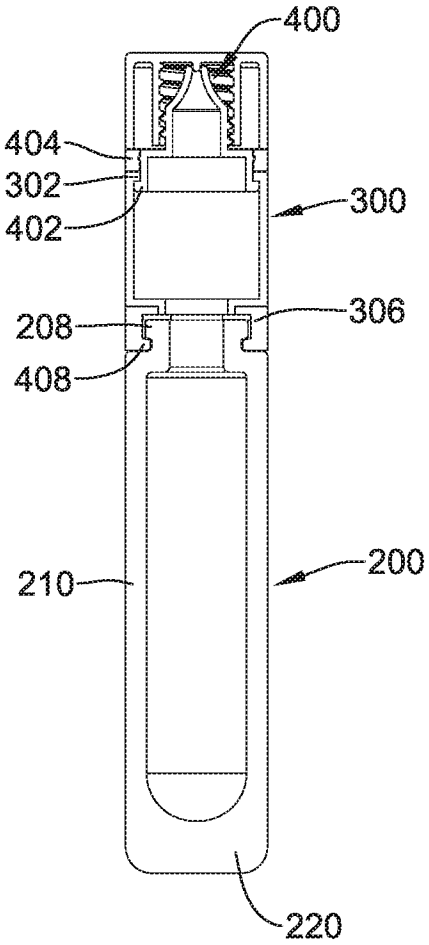
FIG. 4 is a cross-sectional view of a container in accordance with some embodiments.
Figure 3:
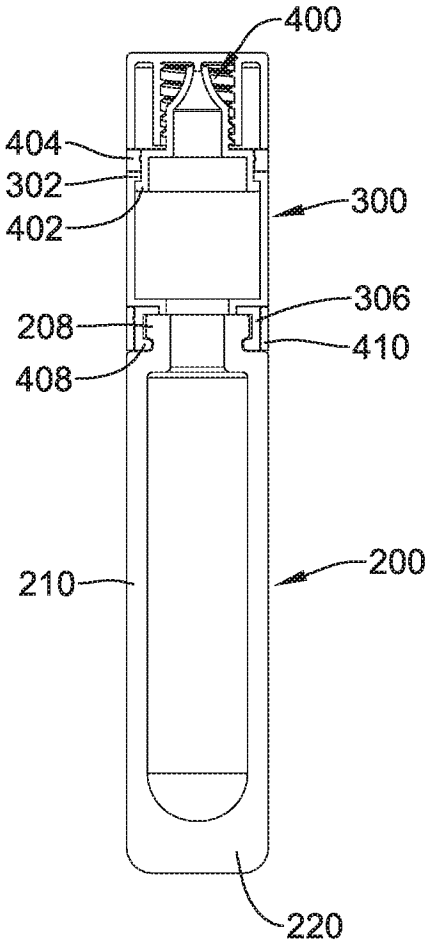
FIG. 3 is a cross-sectional view of a container in accordance with some embodiments.

FIGS. 3-5 depict various embodiments employing snap fit connections as well as overmolding techniques described above in relation to FIG. 1. FIGS. 3 and 4 depict an arrangement similar to that of FIG. 1 for connecting the dispensing tip 400 to the dispensing actuator 300. In each case, the dispensing tip 400 and the dispensing actuator 300 are coupled to one another via a pair of mated annular flanges 402 and 302, respectively. An upper collar 404 is also provided. In addition to being decorative, the upper collar 404 can be used to secure the dispensing actuator 300 to prevent axial movement with respect to the dispensing tip 400. FIG. 5 depicts a similar arrangement, except that the upper collar 404 of FIGS. 3 and 4, is integrally formed with the dispensing tip 400, and forms shoulder 414 which permits the snap fit closure between flanges 402 and 302.

FIGS. 3-5 also depict variations on the connection between the dispensing actuator 300 and the bottle 200. As discussed with regard to FIGS. 1A-1C, FIGS. 3-5 depict the dispensing actuator 300, affixed to a lower collar 306. The overmolding process makes the dispensing actuator 300 and the lower collar 306 a unitary piece, with intermingling of materials at the interface which will be well known to those in the art. As with the embodiment described in FIGS. 1A-1C, the lower collar 306 is coupled to the bottle 200 via a pair of mated flanges, 408 and 208, on the lower collar 306 and bottle 200, respectively. FIGS. 1A-1C, 3, and 5 each depict an optional decorative collar 410. FIG. 4 does not show the decorative collar, rather, lower collar 306 is thicker (e.g., the approximate thickness of the lower collar 306 combined with decorative collar 410).

Figure 6:
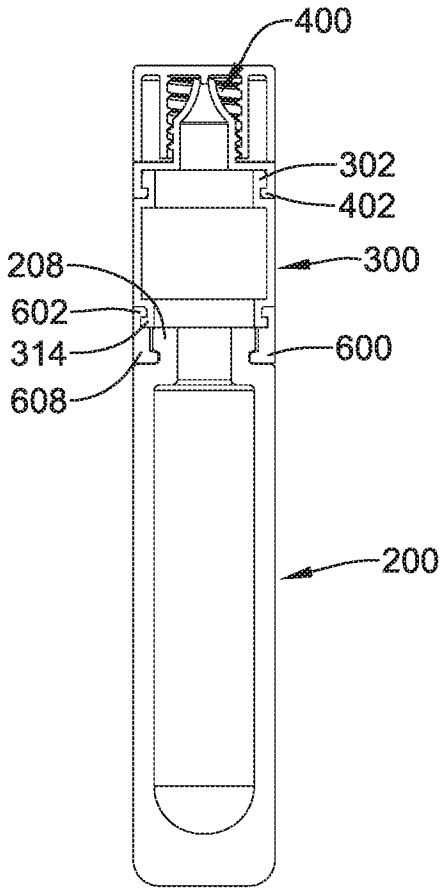
FIG. 6 is a cross-sectional view of a container in accordance with some embodiments.

FIG. 6 depicts another embodiment showing connection of the dispenser actuator 300 to the dispensing tip 400 at one end, and the bottle 200 at the other via a snap fit arrangement employing a series of mated flanges as described in the various embodiments above. In FIG. 6, an annular collar 600 is provided with mated annular flange or barb 602 to mate with flanges 314 provided on the dispenser actuator 300, and also with mated annular flange or barb 608, to mate with flange 208 on the bottle 200.

It should be appreciated from the above description that any suitable arrangement or combination of arrangements may be used to secure the various parts of the multi-part system.

Figure 7:
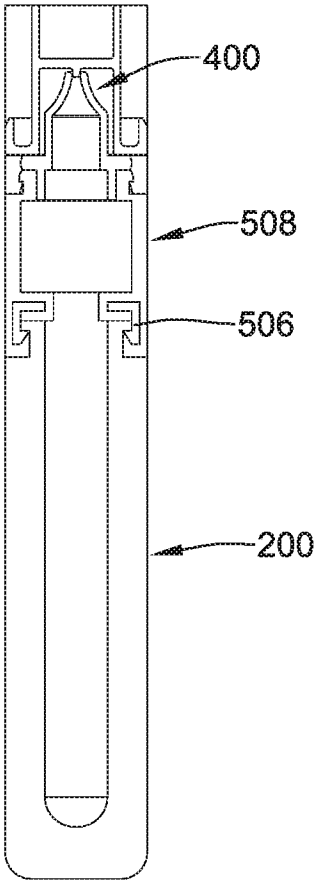
FIG. 7 is a cross-sectional view of a container in accordance with some embodiments.

FIG. 7 depicts another embodiment which employs overmolding techniques to join the various parts. In this instance, a lower collar 506 is overmolded with and becomes part of the dispenser actuator section 508, so as to have a uniform outward appearance. As with other designs, a combination of annular ribs, barbs, or other projections are employed in a mated fashion to hold the various parts together.

Figure 8:
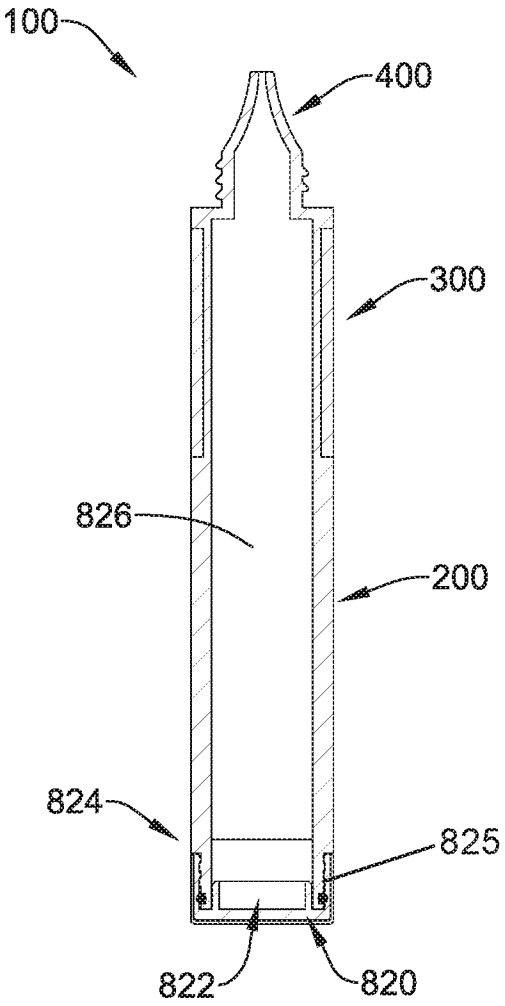
FIG. 8 is a cross-sectional view of a container in accordance with some embodiments.

FIG. 8 illustrates another example container 100 including dispensing tip 400 and bottle 200. As shown in FIG. 8, in some instances bottle 200 may include an opening 822. Opening 822 may be positioned at an end of bottle 200 opposite dispensing tip 400 (e.g., which may be the "bottom" of bottle 200). For example, in some instances opening 822 may be defined as an aperture (e.g., absence of a bottom portion) of bottle 200. In other words, opening 822 may considered an extension of lumen 826 extending within bottle 200.

In some instances, bottle 200 may be coupled to an end cap 820. It is contemplated for purposes of this disclosure that the embodiments disclosed herein may include a bottom opening 822 and corresponding end cap 820. As shown in FIG. 8, end cap 820 may be configured to mate with the end portion 824 of bottle 820. End cap 820 may be coupled to bottle 200 via a variety of connection members 825. For example, end cap 820 may be coupled to bottle 200 via a snap-fit, threads, friction fit, overmolding, or the like. In some instances, end cap 820 may be releasably (e.g., removably) secured to bottle 200. For example, end cap 820 may be removed to facilitate the refilling of bottle 200. After bottle 200 has been refilled, end cap 820 may be reattached to bottle 200.

Figure 9:
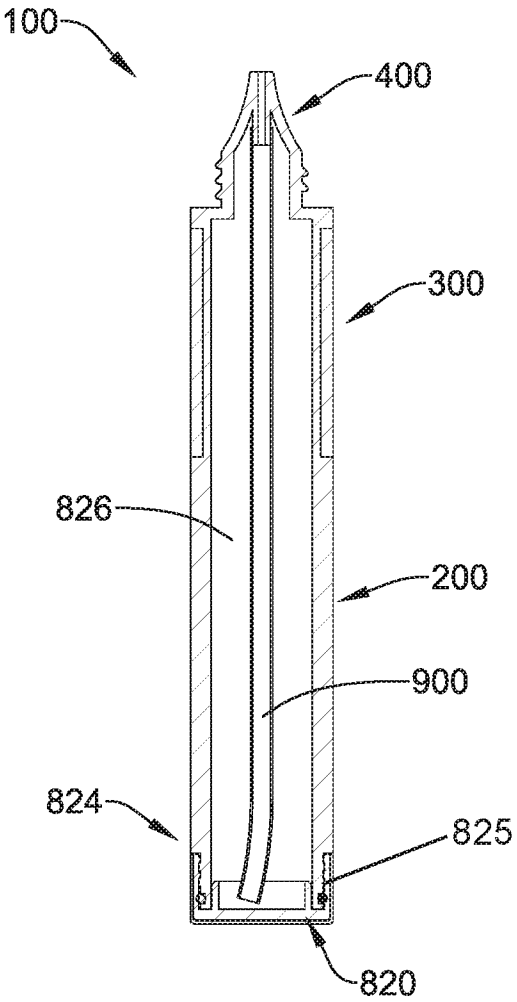
FIG. 9 is a cross-sectional view of a container in accordance with some embodiments.

FIG. 9 illustrates another example container 100 including dispensing tip 400 and bottle 200. FIG. 9 shows container 100 including tube member 900 coupled to dispensing tip 400. Tube member 900 may be referred to as a "dip tube" in some examples. As shown in FIG. 9, tube member 900 may extend from dispensing tip 400 to end portion 824 of bottle 200. In some examples, tube member 900 may extend through lumen 826 of bottle 200. Further, tube member 900 may extend from dispensing tip 400 to a position adjacent end cap 820.

Tube member 900 may be configured to draw, pull, convey, channel, transfer and/or move material from the end portion 824 (e.g., adjacent end cap 820) to the dispensing tip 400. For example, in some examples a vacuum pressure may be created within bottle 200 that draws material through tube member 900. While generally shown as a cylinder (e.g., having a circular cross section) in FIG. 9, it is contemplated that tube member 900 may be any shape and/or size. For example, the cross section of tube 900 may be ovular, triangular, square, or the like. Further, while the discussion herein has described tube member 900 as extending through bottle 200 to a position adjacent the bottom of bottle 200, it is further contemplated that tube 900 may extend from dispensing tip 400 to any location within container 100 and/or bottle 200.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A container for dispensing a cosmetic product, comprising:

a housing defining a cavity for containing a fluid cosmetic product, the cavity having a first open end and a second closed end, the housing including a first portion adjacent the first open end, the first portion having a flexible outer wall defining a first region of the cavity, and a second portion adjacent the second closed end, the flexible outer wall including a circumferential compressible sleeve, wherein the compressible sleeve extends entirely around the first portion of the cavity and is compressible entirely thereabout, the second portion having a rigid outer wall and defining a second region of the cavity, wherein the first and second regions of the cavity are coupled such that when the housing is inverted product flows freely from the second region of the cavity into the first region of the cavity and adjacent the first open end; and a tip including an orifice defining the first open end of the cavity, wherein the orifice is configured to dispense the cosmetic product therethrough;

wherein the circumferential compressible sleeve is configured to be compressed at any location around its circumference to dispense the cosmetic product.

2. The container of claim 1, wherein the flexible outer wall is made from an elastomeric material.

3. The container of claim 1, wherein an amount of compression applied to the sleeve controls an amount of the product dispensed through the tip.

4. The container of claim 3, further comprising an upper collar, wherein the upper collar is positioned around a circumference of the tip, and wherein the upper collar is configured to prevent the compressible sleeve from moving longitudinally with respect to the tip.

5. The container of claim 1, further comprising a cap removably coupled to the tip, the cap configured to seal the orifice.

6. The container of claim 1, wherein an outer diameter of the housing is constant along the first and second portions.

7. A container for dispensing a cosmetic product, comprising:

a bottle defining a first cavity for containing a fluid cosmetic product, the first cavity having a first open end and a second closed end, the bottle having a rigid outer wall;

an actuator defining a second cavity having a first open end and a second open end, the second open end in fluid communication with the first open end of the first cavity such that fluid cosmetic product freely flows back and forth between the second closed end of the first cavity and the first open end of the second cavity, the actuator having a flexible outer wall including a circumferential compressible sleeve, wherein the compressible sleeve extends entirely around the second cavity and is compressible entirely thereabout; and a tip coupled to the first open end of the second cavity, the tip including an orifice in fluid communication with the second cavity, wherein the orifice is configured to dispense the cosmetic product therethrough;

wherein the circumferential compressible sleeve is configured to be compressed at any location around its circumference to dispense the cosmetic product.

8. The container of claim 7, wherein the tip, the bottle or both the tip and the bottle are replaceable.

9. The container of claim 7, wherein the flexible outer wall is made from an elastomeric material.

10. The container of claim 7, wherein an outer diameter of the bottle and an outer diameter of the actuator are the same.

11. The container of claim 7, wherein an amount of compression applied to the actuator controls an amount of product dispensed through the tip.

12. A container comprising:

a bottle having a first open end and a second closed end, the bottle defining a cavity therein, the cavity having a first end in fluid communication with the first open end of the bottle and a second end at the second closed end of the bottle;

a dispensing actuator comprising a flexible sidewall extending circumferentially around a portion of the bottle adjacent the first open end of the bottle, the dispensing actuator defining a first region of the cavity therein, the flexible sidewall including a circumferential compressible sleeve, wherein the compressible sleeve extends entirely around the first region of the cavity and is compressible entirely thereabout; and a dispensing tip defining a dispensing orifice at the first open end permitting flow of a product therethrough upon application of external pressure upon the flexible sidewall;

wherein the bottle and actuator are configured such that product freely flows from the second end of the cavity at the second end of the bottle into the portion of the cavity defined by the dispensing actuator, and adjacent the dispensing orifice of the dispensing tip without application of external pressure upon the flexible sidewall;

wherein the circumferential compressible sleeve is configured to be compressed at any location around its circumference to dispense the cosmetic product.

13. The container of claim 12, wherein the flexible sidewall is made from an elastomeric material.

14. The container of claim 12, wherein an outer diameter of the bottle and an outer diameter of the dispensing actuator are the same.

* * * * *